US008011054B2

(12) United States Patent
Nanda

(10) Patent No.: US 8,011,054 B2
(45) Date of Patent: Sep. 6, 2011

(54) ILLUMINATED FLASHING TOOTHBRUSH AND METHOD OF USE

(75) Inventor: Puneet Nanda, Cerritos, CA (US)

(73) Assignee: Dr. Fresh, Inc., Buena Park, CA (US)

( * ) Notice: Subject to any disclaimer, the term of this patent is extended or adjusted under 35 U.S.C. 154(b) by 0 days.

(21) Appl. No.: 12/355,634

(22) Filed: Jan. 16, 2009

(65) Prior Publication Data

US 2009/0119861 A1 May 14, 2009

Related U.S. Application Data

(63) Continuation of application No. 11/734,732, filed on Apr. 12, 2007.

(51) Int. Cl.
*A46B 15/00* (2006.01)

(52) U.S. Cl. ..... 15/105; 15/167.1

(58) Field of Classification Search ..... 15/105, 15/167.1

See application file for complete search history.

(56) References Cited

U.S. PATENT DOCUMENTS

| | | | | |
|---|---|---|---|---|
| 4,154,997 | A * | 5/1979 | Grebner et al. | 200/536 |
| 4,476,604 | A | 10/1984 | White et al. | |
| 4,779,173 | A | 10/1988 | Carr et al. | |
| 5,030,090 | A | 7/1991 | Maeda et al. | |
| 5,160,194 | A | 11/1992 | Feldman | |
| 5,339,479 | A | 8/1994 | Lyman | |
| 5,382,107 | A | 1/1995 | Nian | |
| 5,572,762 | A | 11/1996 | Scheiner | |
| 6,026,828 | A | 2/2000 | Altshuler | |
| 6,029,304 | A | 2/2000 | Hulke et al. | |
| 6,106,294 | A | 8/2000 | Daniel | |
| 6,154,912 | A | 12/2000 | Li | |
| 6,202,242 | B1 | 3/2001 | Salmon et al. | |
| D458,454 | S | 6/2002 | Nanda | |
| D458,758 | S | 6/2002 | Nanda | |
| 6,623,272 | B2 | 9/2003 | Clemans | |
| D490,247 | S | 5/2004 | Nanda | |
| D492,116 | S | 6/2004 | Nanda | |
| D505,015 | S | 5/2005 | Nanda | |

(Continued)

FOREIGN PATENT DOCUMENTS

CN ZL 03266969.0 8/2004

(Continued)

OTHER PUBLICATIONS

Written Opinion and Search Report of the International Searching Authority from PCT/US2008/060121 mailed Jun. 23, 2008.

(Continued)

*Primary Examiner* — Joseph J Hail
*Assistant Examiner* — Shantese McDonald
(74) *Attorney, Agent, or Firm* — Knobbe, Martens, Olson & Bear, LLP

(57) ABSTRACT

A toothbrush with a handle having a base, a body, and a head. The body having a first section and a second section forming an oblique angle. A projector of a beam of light located within the handle. The toothbrush having at least one bristle attached to the head. The toothbrush having a grip attached to the base. A method of using a toothbrush including the step of gripping the toothbrush. The method further including the step of engaging the projector of a beam of light. The method still further including the step of utilizing the toothbrush while the projector of a light beam is activated.

17 Claims, 7 Drawing Sheets

U.S. PATENT DOCUMENTS

| | | | | |
|---|---|---|---|---|
| 6,954,961 | B2 | 10/2005 | Ferber et al. | |
| 7,201,172 | B2 | 4/2007 | Nanda | |
| 2003/0205492 | A1* | 11/2003 | Ferber et al. | 206/362.2 |
| 2004/0057233 | A1* | 3/2004 | Sharrah et al. | 362/205 |
| 2004/0143920 | A1* | 7/2004 | Nanda | 15/105 |
| 2006/0174431 | A1 | 8/2006 | Nanda | |
| 2007/0039109 | A1 | 2/2007 | Nanda | |
| 2007/0131241 | A1 | 6/2007 | Nanda | |
| 2008/0250591 | A1 | 10/2008 | Nanda | |
| 2008/0276398 | A1 | 11/2008 | Nanda | |
| 2009/0070947 | A1* | 3/2009 | Baertschi et al. | 15/22.1 |

FOREIGN PATENT DOCUMENTS

| | | | |
|---|---|---|---|
| JP | 2004-222839 | A | 8/2004 |
| JP | 2006-42966 | A | 2/2006 |
| KR | 10-2004-0052897 | A | 6/1994 |
| KR | 10-0476657 | B1 | 3/2005 |

OTHER PUBLICATIONS

Written Opinion and Search Report of the International Searching Authority from PCT/US2008/082886 mailed Jan. 23, 2009.

* cited by examiner

ILLUMINATED FLASHING TOOTHBRUSH AND METHOD OF USE

PRIORITY INFORMATION

This application is a continuation of co-pending application Ser. No. 11/734,732, filed Apr. 12, 2007, the entirety of which is herein incorporated by reference.

BACKGROUND OF THE INVENTION

1. Field of the Invention

The present inventions relate to dental hygiene and, more particularly, to toothbrushes.

2. Description of the Related Art

To ensure proper oral care, dentists recommend that we brush our teeth more than once a day for at least two to three minutes each time. Despite this recommendation, the average adult person does not brush his or her teeth for two to three minutes. This problem is worse with children, who have notoriously short attention spans and often view brushing their teeth as a chore. Accordingly, there is a general need for a device that encourages people, especially children, to brush their teeth more often and for longer periods of time. See e.g., U.S. Patent Publication No. 2004-0143920, filed Jan. 24, 2003 and published on Jul. 29, 2004, the entirety of which is hereby incorporated by reference herein.

SUMMARY OF THE INVENTION

U.S. Patent Publication No. 2004-0143920 describes a toothbrush with a handle having a base, a body, and a head. The body can have a first section and a second section forming an oblique angle. A projector of a beam of light located within the handle. The toothbrush can have at least one bristle attached to the head. The toothbrush can have a grip attached to the base. An illumination circuit can be positioned within the handle and is operated by pressing an end of the handle. Pressing, the end of the handle can compress a spring which completes the illumination circuit, activating the projector of a light beam within the toothbrush. Applicant has recognized that some children may have trouble activating the illumination circuit. Accordingly, a need exists for an improved activation mechanism.

Thus, one aspect of the present invention is a toothbrush comprising a handle having a first end and a second end and a head coupled to the first end of the handle, the head comprising a plurality of bristles. A pliant base is coupled to the second end of the handle. A light is positioned in the handle. The tooth brush also include a power source coupled to the light, a first contact member, a second contact member and a flexible member that extends around the first contact member and is coupled to the second contact member such that the second contact member contacts the first contact member as the pliant base is compressed or bent but does not contact the first member when the pliant base is in an unstressed condition. A control circuit configured such that contact between the first contact member and the second contact member completes a circuit and initiates illumination of the light for a set period of time.

Another aspect of the present invention is a toothbrush comprising a handle having a first end and a second end and a head coupled to the first end of the handle, the head comprising a plurality of bristles. A pliant base is coupled to the second end of the handle. A light is positioned in the handle. The toothbrush also includes a power source, a first contact member, a second contact member and means for separating the first contact member from the second contact member flexible member and for permitting contact between the first and second contact member when the pliant base means is deflected in a direction transverse to the longitudinal axis. A control circuit configured such that contact between the first contact member and the second contact member completes a circuit and initiates illumination of the light for a set period of time.

Yet another aspect of the present invention is a toothbrush comprising a handle having a first end and a second end and a head coupled to the first end of the handle, the head comprising a plurality of bristles. A pliant base is coupled to the second end of the handle. A light is positioned in the handle. The toothbrush also includes a power source, a first contact member that is generally stationary with respect to the power source and a second contact member that moves with respect to the first contact member as the actuation member is moved. A control circuit configured such that contact between the first contact member and the second contact member completes a circuit and initiates illumination of the light for a set period of time.

The foregoing objects may also be achieved by a toothbrush having a handle having a base, a body, and a head. The body having a chamber therein. A projector of a beam of light within the chamber. The toothbrush having at least one bristle attached to the head. The toothbrush having a grip attached to the base.

The foregoing objects may still further be achieved by a method of using a toothbrush. The method uses a toothbrush having a handle and an illumination circuit. The toothbrush handle having a base, a body, and a head. The toothbrush illumination circuit having a projector of a beam of light connected to a switch. The method including the step of gripping the toothbrush. The method further including the step of engaging the switch for completing the illumination circuit. The method still further including the step of activating a projector of a light beam within the toothbrush. The method still further including the step of utilizing the toothbrush while the projector of a light beam is activated.

DETAILED DESCRIPTION OF THE PREFERRED EMBODIMENTS

Figure 1:
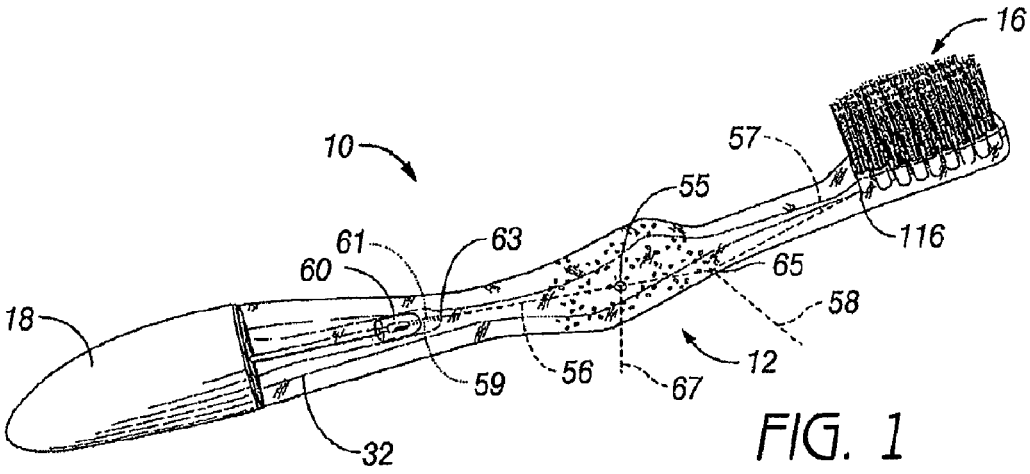
FIG. 1 (PRIOR ART)
FIG. 1 is a perspective view of a prior art toothbrush.
Figure 2:
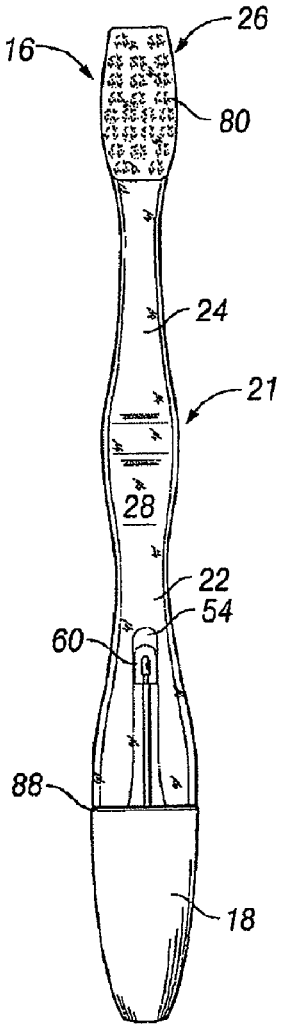
FIG. 2 (PRIOR ART)
FIG. 2 is a front elevation view of the toothbrush of FIG. 1 showing the brush side of the toothbrush.
Figure 3:
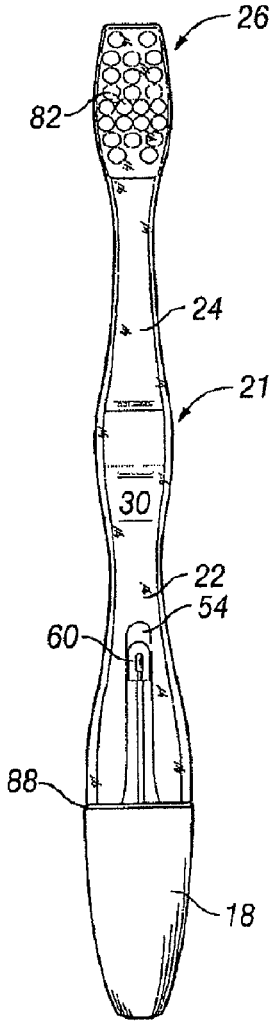
FIG. 3 (PRIOR ART)
FIG. 3 is a rear elevation view of the toothbrush of FIG. 1 showing the non-brush side of the toothbrush.

FIG. 1 illustrates a prior art illuminated toothbrush 10, which comprises a handle 12, an illumination circuit 14, a brush 16, and a grip 18.

As shown in FIG. 1, the handle 12 comprises a base 20, a body 21, and a head 26. The body 21 has a first section 22 and a second section 24. The handle 12 can be formed of hard, clear plastic. In one arrangement, the handle 12 can be a colored plastic. In another arrangement, the handle 12 can be a translucent plastic. In yet another embodiment, the handle 12 may be fashioned out of a plastic incorporating metallic flake 55.

The toothbrush handle 12 can be formed through an injection molding process. In such an embodiment, plastic in a liquid form can be injected into a mold having two sections. Liquid plastic can be injected into the mold where it is then allowed to solidify. When the mold is opened it creates a handle having a brush side 28 and a non-brush side 30. At the intersection of these two sides 28, 30 can be a ridge 32. The ridge 32 can be a surface characteristic resulting from the injection molding process. In the illustrated arrangement, the ridge 32 does not extend inside the handle 12 but exists on the surface. The injection molding process in constructing of the toothbrush handle 12 is conventional and does not form a part of the present invention.

Figure 5:
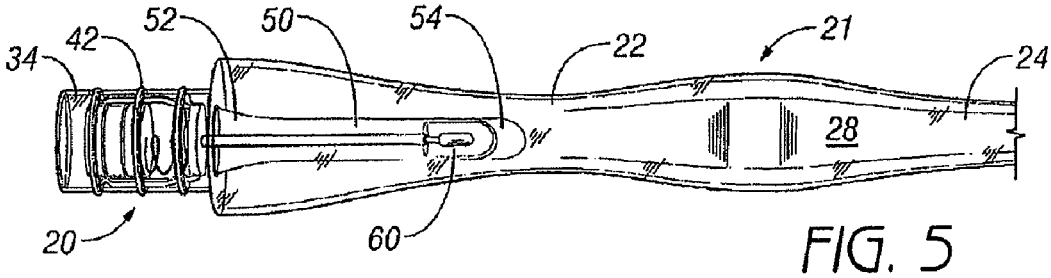
FIG. 5 (PRIOR ART)
FIG. 5 is a top view of the toothbrush with the grip removed exposing the toothbrush base and illumination circuit held within.
Figure 6:
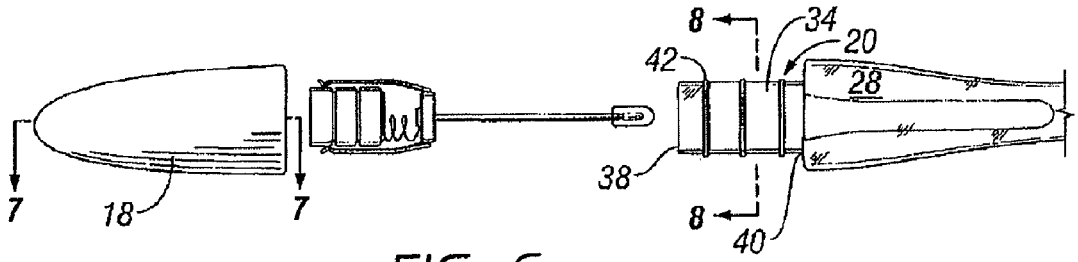
FIG. 6 (PRIOR ART)
FIG. 6 is an exploded top view of the toothbrush grip, base, and lower section of toothbrush handle showing the placement of the illumination circuit within the toothbrush handle.
Figure 8:
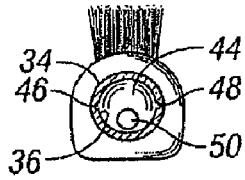
FIG. 8 (PRIOR ART)
FIG. 8 is a sectional view of the base in FIG. 6 showing the indentations for containing the positive terminal conductors.
Figure 9:
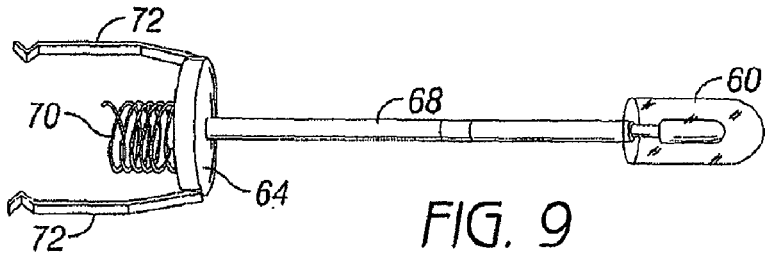
FIG. 9 (PRIOR ART)
FIG. 9 is a perspective view of the illumination circuit without the power supply.
Figure 10:
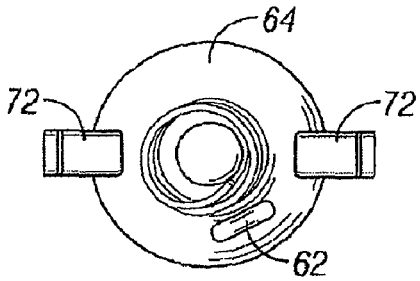
FIG. 10 (PRIOR ART)
FIG. 10 is a bottom view of the illumination circuit.
Figure 11:
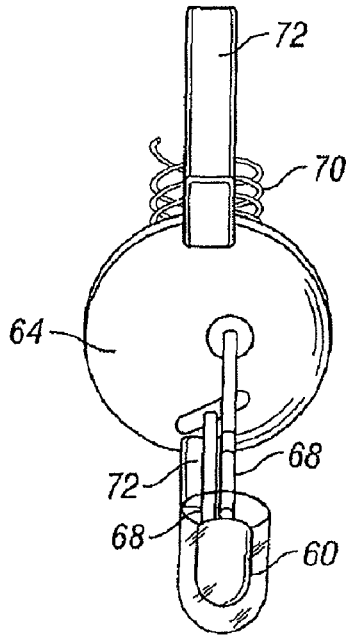
FIG. 11 (PRIOR ART)
FIG. 11 is a top perspective view of the illumination circuit.

As seen in FIGS. 5, 6, and 8, the handle 12 can include a handle base 20. The base 20 can be generally cylindrical in shape and can have a circumferential groove or cavity 44 therein. The circumferential groove 44 can have a centerline. The base 20 has an outside surface 34, an inside surface 36, a first end 38, and a second end 40. In the illustrated arrangement, on the outside surface 34 of the base 20 are three annular rings 42. The annular rings 42 can provide a ledge upon which the grip 18 holds.

The inside surface 36 defines the cavity 44. The inside surface 36 can have a first indentation 46 and a second indentation 48. The cavity 44 can serve as a housing for the illumination circuit 14. The first and second indentation 46, 48 can serve as a guide for positioning the illumination circuit 14 within the base 20.

A chamber 50 can extend within the section 22. The chamber 50 has a first end 52 and a second end 54. The chamber 50 can be generally cylindrical in shape. The first end 52 can be rounded and can provide a transition between the chamber 50 filled full of air and the first section 22 which is of plastic. The air is inherently present as a result of assembly at a time after the handle was formed. Alternatively, the chamber may be filled full of a material in a process separate from the forming of the handle.

The second end 54 of the chamber 50 can be open to the first end 38 of the base 20. The first section chamber 50 can be in off-center alignment with the base 20. As seen in FIG. 8, the first section chamber 50 is in off-center alignment with the base 20 to allow the projector of a light beam or illuminating member 60 to emit a light beam 56 that travels through the first section 22 and to strike the interface 65 between the second section 24 and atmosphere. At this interface, a light beam 57 can be reflected towards the handle head 26 and a light beam 58 can be refracted towards the atmosphere.

The first section chamber 50 can be also positioned in off-center alignment with the base 20 because in the first section 22 is ergometrically designed to accommodate a user's grip. In the ergometric design, the brush side 28 of the first section 22 is contoured and the non brush side 30 of the first section 22 is flat. In addition, the brush side 28 of the first section 22 arrives at a point of the second section 24 at a greater angle than the non brush side 30. In other words, the illumination circuit 14 extends within the first section 22 substantially parallel to the center line of the base member 20 but the first section 22 brush side 28 angles toward the inner point where the first section 22 meets the second section 24 and the non brush side 30 portion of the first section 22 also angles toward the point where the first section 22 meets the second section 24. Thus, for the first section chamber 50 to extend the furthest into the first section 22 of the handle 12, the first section chamber 50 is preferably positioned closer to the non-brush side 30 of the first section 22.

The illumination circuit 14 can have an illuminating member or projector of a light beam 60, a resistor 62, a timing circuit 64, and a power source 66. These parts can be joined by the conductor 68, which provides a support structure extending the illuminating member 60 a distance away from the timing circuit 64. The negative terminal conductor 70 can be a spring which presses against the power source 66, which in the illustrated arrangement comprises a series of batteries. The positive terminal conductor 72 can comprise a pair of prongs that extends away from the timing circuit 64 to embrace the power source 66. The positive terminal conductor 72 can also be sized to stabilize the illumination circuit 14 within the base 20 as the positive terminal conductor 72 is sized to fit within the first indentation 46 and the second indentation 48 of the base 20.

The illumination member 60 in this embodiment is a light emitting diode (LED). In other embodiments, the illumination member 60 could be an incandescent light bulb. In still other embodiments, the illumination member 60 may be any other device known in the art that may provide illumination.

The power source 66 in one arrangement can be micro-cell battery model number G3-ACNB. In the illustrated arrangement, three batteries are placed in series within the base 20. The timing circuit 64 preferably can function to illuminate the illumination member 60 for approximately 60 seconds. The timing circuit 64 also preferably can serve to control the illumination member 60 to blink intermittently for the time period in which it is engaged. In some embodiments, the illumination member 60 may stay on continuously and/or illuminate for a longer or shorter period of time. In the illustrated embodiment, the circuit is activated by closing an electrical switch 74 to complete a circuit.

The brush 16 can have a bristle 80. The bristle 80 can have a first end 82 and a second end 84. The bristle second end 84 can be embedded in the head 26 of the handle 12. In one arrangement, the bristle 80 can be made of clear plastic material. Moreover, in such an arrangement, the brush 10 can be configured such that, when the bristle 80 is struck by light traveling from the illumination member 60 through the first section 22 and the second section 24, a portion of the light striking the bristle 80 may reflect through the bristle 80 and extend out of the bristle 80.

Figure 4:
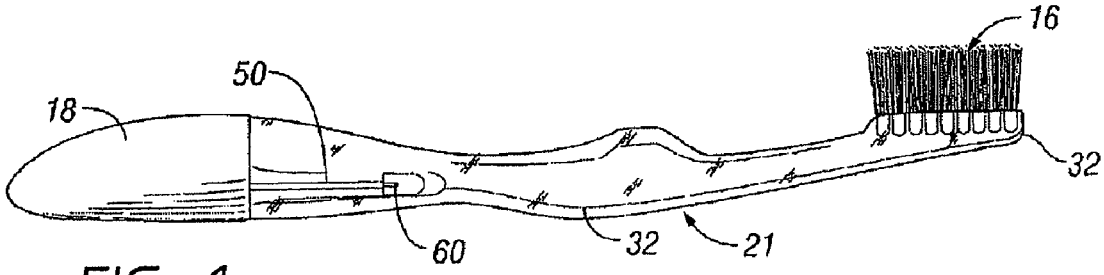
FIG. 4 (PRIOR ART)
FIG. 4 is a side view of the toothbrush of FIG. 1 showing the chamber preferentially placed near the non-brush side.
Figure 7:
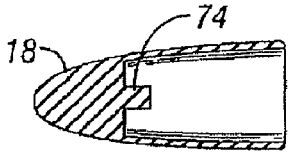
FIG. 7 (PRIOR ART)
FIG. 7 is a sectional view of the grip of FIG. 6.

The grip 18 can be made of a flexible material. In the illustrated arrangement, the grip 18 can also serve as a switch. For example, the grip 18 can have an extending piece or switch 74 of flexible material as seen in FIG. 7. When the grip is pushed in the direction of arrow A in FIG. 4, the piece 74 moves the positive terminal metal conductor 72 to contact the power source 66. Alternatively, the piece 74 moves the power source 66 to contact the positive terminal metal conductor 72. In doing so, the piece 74 moves illumination circuit 14 from an un-illuminated position to a illuminated position. The grip 18 can remain in place on the base 20 by engaging the annular rings 42 on the outside surface 34 of the base 20. An adhesive 88 can be positioned between the first section 22 and the grip 18 to hold the grip 18 in close connection with the first section 22.

The grip 18 can be made of a flexible material. Alternatively, the grip 18 may be of a hard material but have a flexible portion that may be used to engage the positive terminal conductor 72 and press against the power source 66.

In operation, the illuminated toothbrush 10 is used by a user to indicate the duration of an amount of time. The user grips the toothbrush handle 12 in their hand with the bristle 80 surface with the bristle 80 against their teeth and engages the illumination circuit switch 74. The illumination member 60 begins to blink intermittently in an on/off fashion. The illumination member 60 continues to blink for a period of approximately 60 seconds. The handle is designed to direct light to the user in multiple ways so that the user may be accurately apprised of brushing time. The frequency of blinking can remain constant, or vary in frequency. In some embodiments, the frequency can increase as the time approaches 60 seconds. In some embodiments, the frequency can remain constant through a first period of time, and increase in frequency in a second period of time. In one example, the frequency can remain constant for approximately 45 seconds; then increase for the remaining 15 seconds. In other embodiments, different time intervals can be used, such as, for example, two even periods of thirty seconds each.

A light beam 59 travels from the illuminating device 14 through a first section chamber 50. The light beam 59 strikes an interface 63 between the first section chamber and the first section and a light beam 61 is partially reflected off of the interface and a light beam 56 is refracted enters the first chamber. The light beam 56 travels through the first section 22 to strike upon an interface 65 between the second section 24 and atmosphere. A light beam 57 is reflected from interface 65 toward head 26 and a light beam 58 is refracted towards the atmosphere. The light beam 57 then strikes an interface 116 between the head 26 and bristle 80 where it is partially reflected and refracted.

Alternatively, the toothbrush handle may have a metallic piece 55 or flake embedded in the hardened plastic. The angle of reflection upon the flake is equal to the angle of incidence upon the flake. These metallic pieces 55 can be glitter. In operation, light will strike these metallic pieces 55 at an angle of incidence and the reflected light beam 67 directed at an angle of reflection as seen in FIG. 1.

One disadvantage of the arrangement described above is that the mechanism for completing the activation of the illumination is mechanically inefficient and often requires a degree of strength and dexterity not possessed by children.

Figure 13:
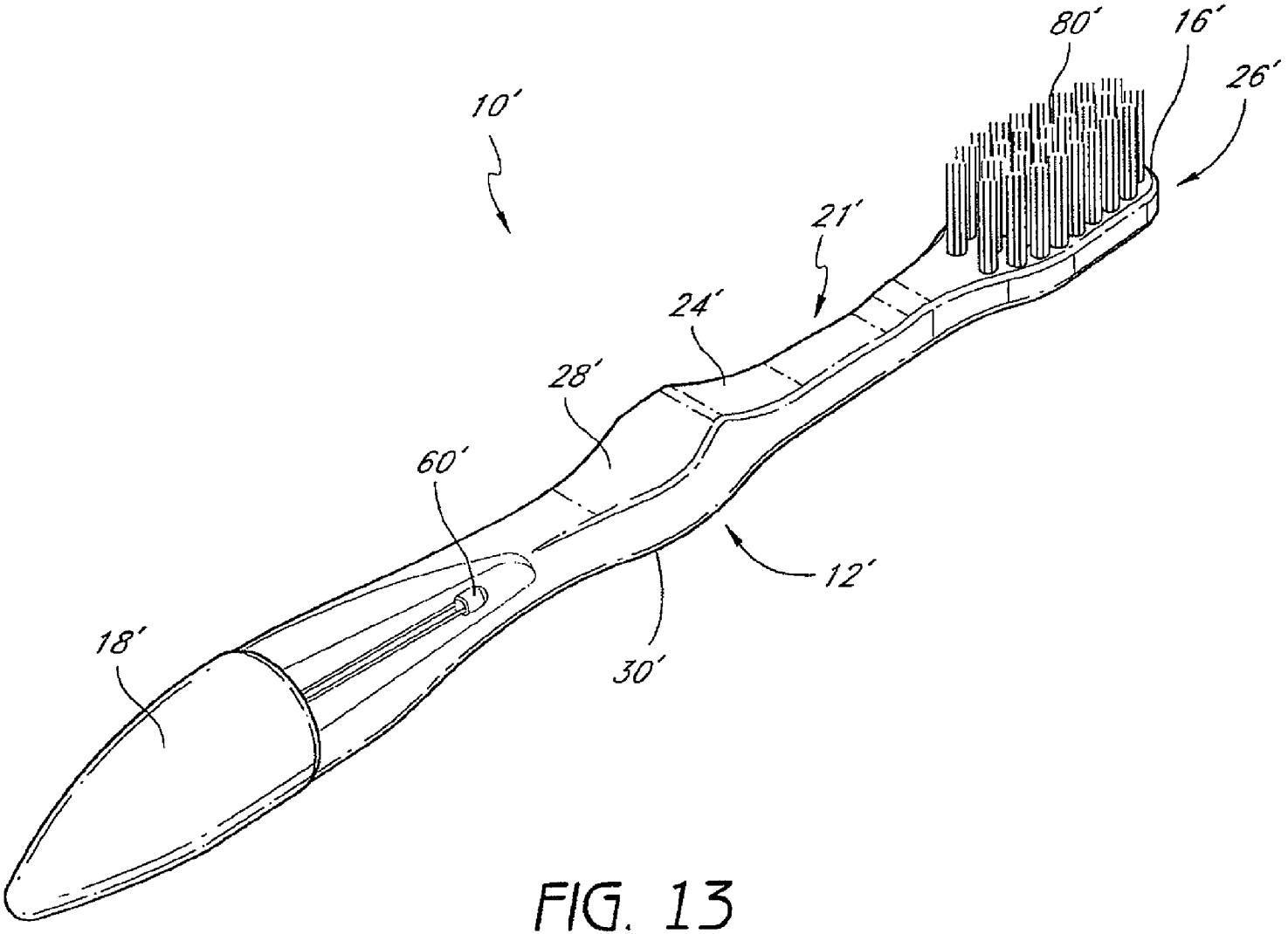
FIG. 13 is a brush side perspective view of a toothbrush having certain features and advantages according to the present invention.
Figure 14:
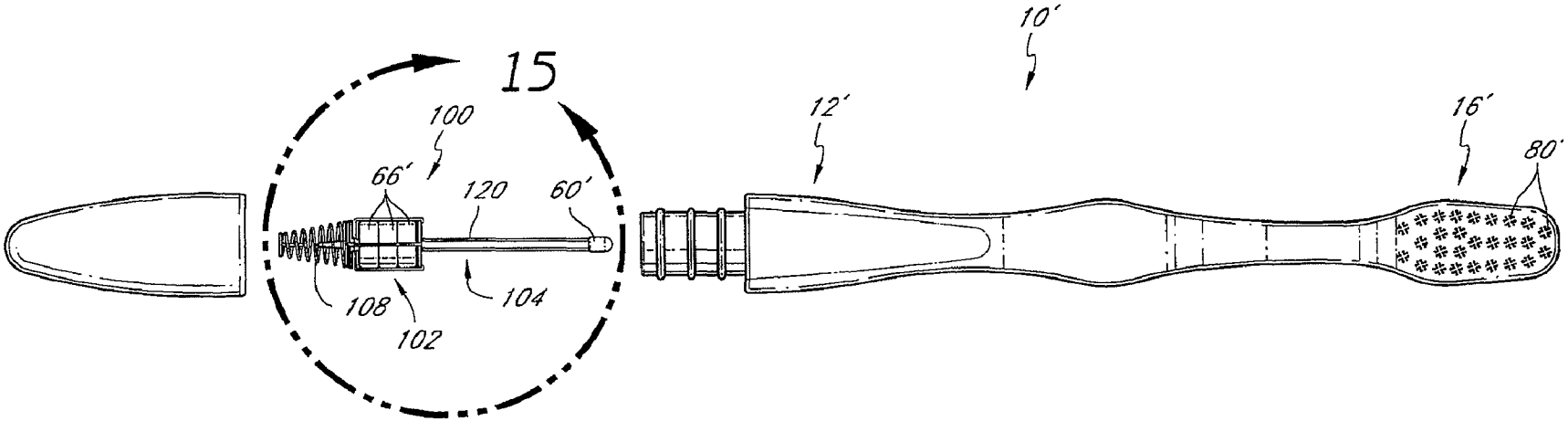
FIG. 14 is top brush side exploded view of the tooth brush of FIG. 13.
Figure 15:
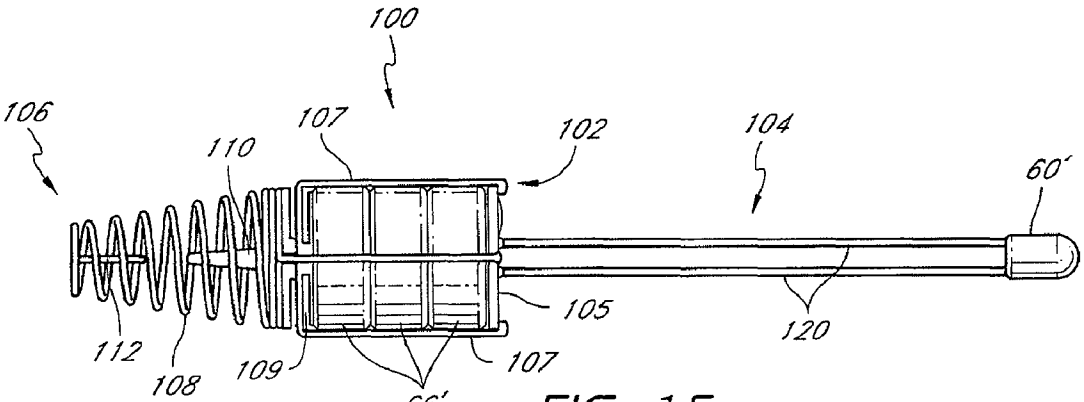
FIG. 15 is a closer view of section 15 of FIG. 14.

FIGS. 13, 14, and 15 illustrate a modified embodiment of a toothbrush that advantageously addresses the aforementioned problem. Numerical reference to components is the same as in the previously described arrangement, except that a prime symbol (') has been added to the reference. Where such references occur, it is to be understood that the components are the same or substantially similar to previously-described components.

As can be seen the toothbrush can have an improved light generation mechanism 100. The mechanism 100 can be disposed in the base 18', as described above. In the illustrated embodiment, the mechanism 100 comprise a power portion 102, an extension portion 104, and an activation portion 106. The illuminating member 60' can be disposed at one end of one or more extension members 120, which can form the extension portion and can extend toward the base 18' and couple with the power segment 102.

The power segment 102 can comprise one or more power sources (e.g., batteries) 66'. The power sources 66' can be positioned between a distal member 105 and a proximal member 109, which in one embodiment can each comprise a circular disk-like plate. The power sources 66' can be secured in the space between the distal and proximal members 105, 109 and can be engaged by one or more generally rigid elongate members 107. The elongate members 107 can extend along the longitudinal axis of the toothbrush 10'. For additional security, the power sources 66' can be surrounded by a cylindrical member (not shown) that can be made of plastic or other similar material. In this manner, the power sources 66' cannot be easily dislodged from the power segment and swallowed by children if the base 18' is removed.

The power sources 66' can be in direct contact with each other or have an intervening electrical connection member (not shown). The power segment 102 can be coupled to an activation segment 106. The activation segment 106 can have a spring member 108. The spring member 108 can be a conical, as in the illustrated embodiment, or cylindrical, or any other shape appropriate for the interior or the base 18'. The spring member 108 can be composed of metal, though other materials can be used in other embodiments. Advantageously, an electrically-conducting material can be used. The spring member 108 can have an inward-extending protrusion 112 at one end. The protrusion 112 can be of any size or shape sufficient to extend towards the power sources 66' without contacting them. The protrusion 112 can be composed of the same material as the spring member 108, or can be composed of a different material, preferably an electrically-conductive material. In certain embodiments, the spring member 108 can be composed of a plastic and the protrusion 112 can be a metal. The spring member 108 can have an insulating or conducting coating.

The power segment 102 can have a contact member 110 extending toward the protrusion 112. The contact member 110 can be electrically-connected to the power sources 66' and the illumination circuit 14'. The contact member 110 can be connected such that contact with the protrusion 112 activates the illumination circuit 14'. Additionally, when electrically-conducting materials are used for the spring member 108, such as the metal in the illustrated embodiment, contact between the sides of the flexible member 108 and the contact member 110 can also activate the illumination circuit 14'.

Thus, although the illustrated embodiment is shown in FIGS. 14 and 15 in an exploded view, when the toothbrush 10' is assembled as in FIG. 13, manipulation of the pliable base 18' can cause deflection of the spring member 108 within. If the bottom of the base 18' is pushed toward the power segment 102, the protrusion 112 can touch the contact member 110, causing illumination. Alternatively, if the base 18' is deflected towards either side, the interior of the spring member 108 can touch the contact member 110, also causing illumination. The illumination can be continuous or intermittent. Additionally, the intervals between illuminations during intermittent operation can be regular or have increasing or decreasing frequency.

Figure 16:
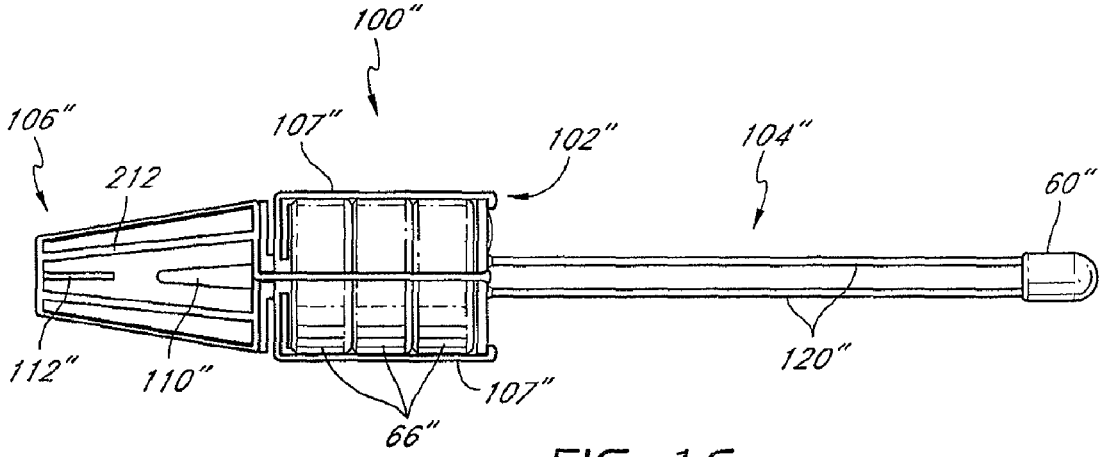
FIG. 16 is another embodiment of an illumination circuit.

FIG. 16 illustrates another embodiment of an illumination circuit. Numerical reference to components is the same as in previously described arrangements, except that a double prime symbol (") has been added to the reference. Where such references occur, it is to be understood that the components are the same or substantially similar to previously-described components.

Figure 12:
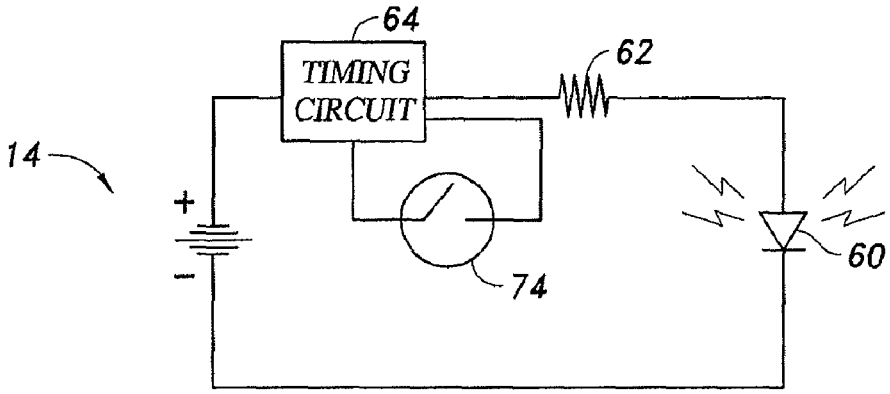
FIG. 12 is a schematic drawing of the illumination circuit.

As in other embodiments, a contact member 110" can be attached to a power segment 102". The contact member 110" can activate a circuit 14", as illustrated in FIG. 12. The embodiment of a mechanism 100" depicted in FIG. 16 has a plurality of flexible members 212 which enclose the contact member 110". The flexible members 212 can be composed of metal, an elastomer, or any of a variety of other materials which permit flexibility and have, or can support, an electrically-conductive surface. An inward-extending protrusion 112" can be integrally formed with the flexible members 212.

Unlike the cone-shaped spring member depicted in the embodiment illustrated in FIG. 15, the flexible members 212 can extend along a longitudinal axis of the mechanism 100". In some embodiments, the flexible members 212 taper inwardly as they extend away from the contact member 110". In other embodiments, the flexible members 212 do not taper, and maintain an approximately cylindrical shape. In yet other embodiments, the flexible members 212 can have other arrangements, including without limitation, a pyramidal prism, a rectangular prism, a cubic shape, or other geometrical shapes sized appropriately to surround the contact member 110".

Figure 17:
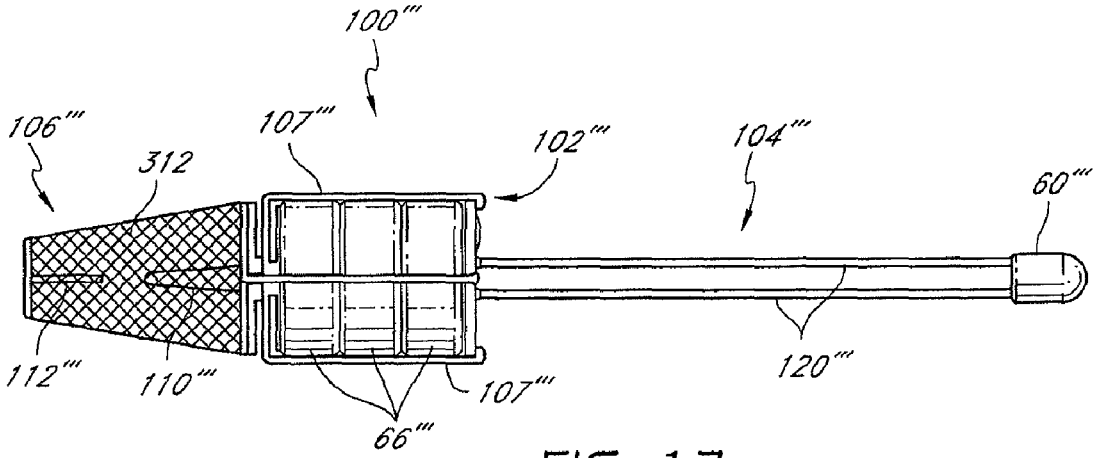
FIG. 17 is another embodiment of an illumination circuit.

FIG. 17 illustrates another embodiment of an illumination circuit 100'''. Numerical reference to components is the same as in previously described arrangements, except that a triple prime symbol (''') has been added to the reference. Where such references occur, it is to be understood that the components are the same or substantially similar to previously-described components.

The contact member 110''' can be enclosed within a flexible mesh, such as a metal wire mesh 312. The mesh 312 can have an interior contact surface which activates the illumination circuit 100''', or can structurally support such a surface. The wire mesh 312 can have an inward-extending protrusion 112''', as illustrated. In some embodiments, more than one protrusion is present on the interior of the component disposed around the contact member 110'''. These embodiments can include the use of spring members, flexible rods, flexible meshes, or any other contact surface or surface support configured to activate the illumination circuit.

Figure 18:
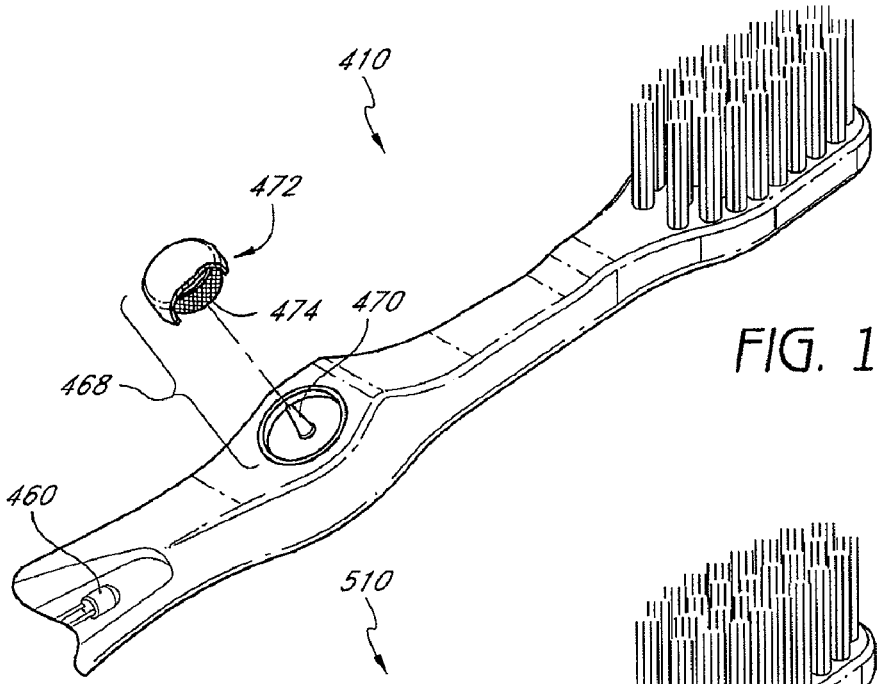
FIG. 18 is a perspective view of an embodiment of a toothbrush with a front-mounted button.
Figure 19:
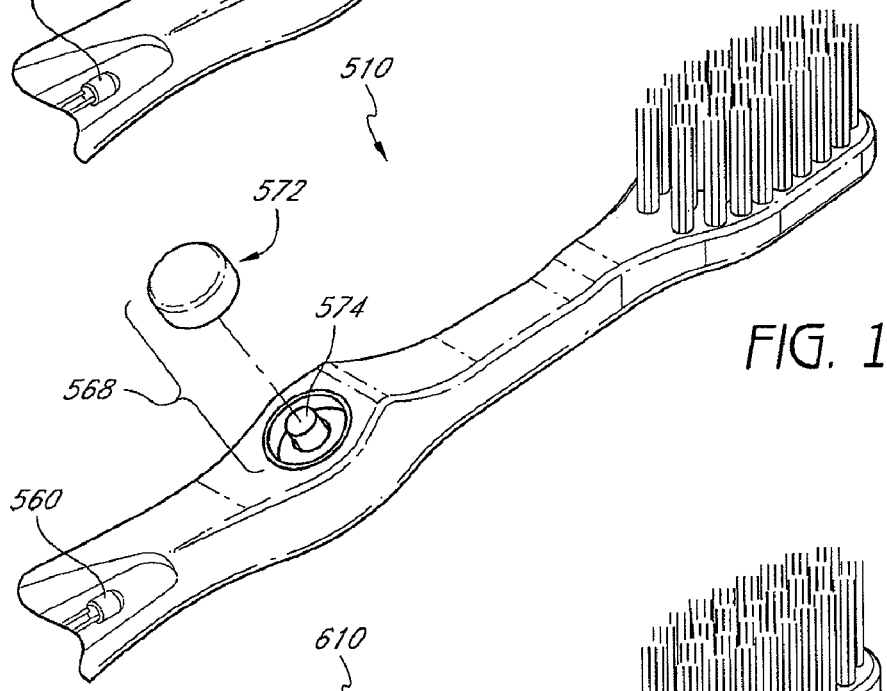
FIG. 19 is a perspective view of another embodiment of a toothbrush with a front-mounted button.
Figure 20:
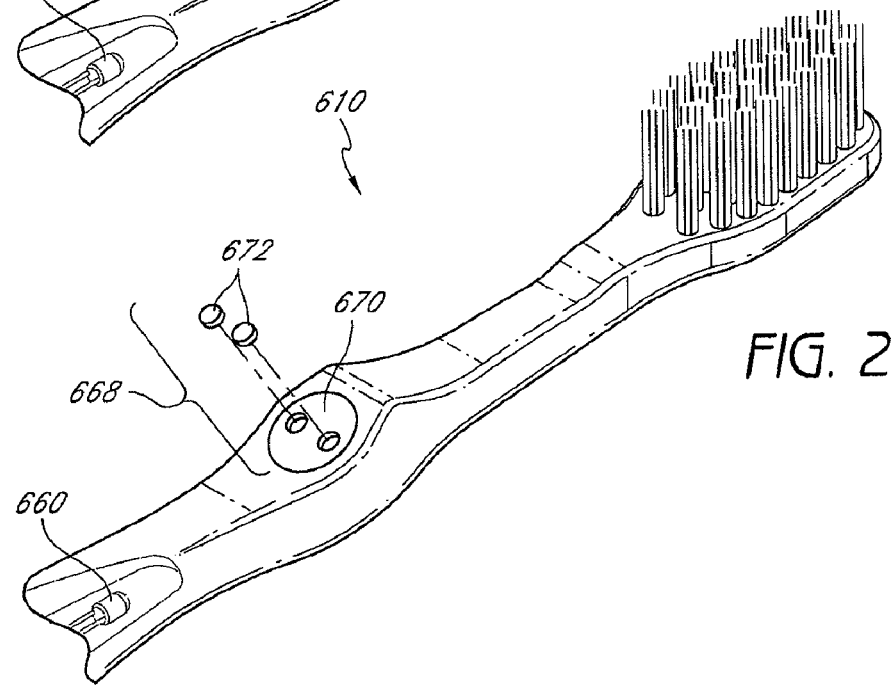
FIG. 20 is a perspective view of another embodiment of a toothbrush with a front-mounted button.

FIGS. 18-20 illustrate alternative embodiments of the toothbrush having a front-mounted activation mechanism for activating an illumination circuit 14. The mechanism can comprise a variety of devices, some examples of which are illustrated and described below.

FIG. 18 illustrates an embodiment of a toothbrush 410 having an illumination member 460 and an activation mechanism 468. The mechanism 468 can comprise a contact port 470 and a button 472. The button 472 can comprise a metallic mesh 474 that surrounds the contact post 470, and activates an illumination circuit 14, lighting the illumination member 460, as described above. The mesh 474 can case the illumination circuit 14 to activate through contact with an electrically-conducting inner surface, or support an electrically-conducting surface which activates the circuit 14. The mesh 474 can be replaced by a spring, flexible rods, or any other suitable device, as described above.

FIG. 19 illustrates another embodiment of a toothbrush 510 having a front-mounted activation mechanism. The mechanism can comprise a push-button device 568 having a button 572 and a switch device 574, as are well-known in the art. The push-button device 568 can cause the illumination member 560 to blink by activating an illumination circuit 14. The switch device 574 can be activated by manipulation of the button 572, whether the button 572 is flexible or a rigid connection to the switch device 574. The push-button device 568 can activate the circuit 14 once manipulated, and future manipulations can be ignored by the circuit 14 until the timer has completed a cycle. This operation can occur in any embodiment described herein.

FIG. 20 illustrates another embodiment of a toothbrush 610, wherein an illumination member 660 is set to blink by an illumination circuit 14. The circuit 14 can start a timed cycle upon receiving a signal from an activation device 668. In the illustrated embodiment, the activation device 668 comprises a base 670 and two contact terminals 672. The contact terminals 672 can activate the circuit 14 when electrical conduction occurs between the terminals 672. In one embodiment, the circuit 14 and terminals 672 can be constructed to allow contact with human skin to both terminals 672 to cause conduction to occur, thereby activating the circuit 14. In non-limiting examples, the palm of a human hand gripping the toothbrush can activate the circuit or, a finger or thumb pressed to touch both terminals 672 can activate the circuit 14. Water disposed in continuous contact with both terminals 672 can also activate the circuit 14.

Although certain embodiments, features, and examples have been described herein, it will be understood by those skilled in the art that many aspects of the methods and devices shown and described in the present disclosure may be differently combined and/or modified to form still further embodiments. For example, any one component of the infusion sets shown and described above can be used alone or with other components without departing from the spirit of the present invention. Additionally, it will be recognized that the methods described herein may be practiced in different sequences, and/or with additional devices as desired. Such alternative embodiments and/or uses of the methods and devices described above and obvious modifications and equivalents thereof are intended to be included within the scope of the present invention. Thus, it is intended that the scope of the present invention should not be limited by the particular embodiments described above, but should be determined only by a fair reading of the claims that follow.

What is claimed is:

1. A toothbrush comprising:

a handle having a base and a head;

a light positioned in the handle;

a pliant base comprising a first portion attached to the base of the handle and a second portion spaced therefrom, wherein the second portion of the pliant base is configured to move in one of multiple directions with respect to the first portion to illuminate the light, including a sideways direction and a downward direction;

a plurality of bristles attached to the head of the handle;

a power source connected to the light;

a first contact member positioned within the pliant base; and a second contact member positioned within the pliant base and configured to move with the second portion of pliant base, wherein the second contact member surrounds the first contact member such that the second contact member contacts the first contact member when the pliant base is moved downward and when it is moved sideways but does not contact the first member when the pliant base is in an unstressed condition, wherein when the first contact member contacts the second contact member the light is illuminated for a period of time.

2. The toothbrush of claim 1, wherein the second contact member comprises a helical spring, the first contact member and the helical spring both extend from a base member.

3. The toothbrush of claim 2, wherein the first contact member comprises a generally elongated rod extending from the base member and positioned within the helical spring.

4. The toothbrush of claim 1, wherein the second contact member comprises at least one of a metal mesh, a truncated cone, and a helical spring.

5. A toothbrush comprising:

a handle having a first end and a second end;

a head coupled to the first end of the handle, the head comprising a plurality of bristles;

a light positioned in the handle;

a pliant base coupled to the second end of the handle, the pliant base configured to move in multiple directions to illuminate the light, including a sideways direction and a downward direction;

a power source coupled to the light;

a first contact member;

a second contact member that extends around the first contact member and is configured to move with the pliant base such that the second contact member contacts the first contact member when the pliant base is compressed and when it is bent but does not contact the first member when the pliant base is in an unstressed condition; and a control circuit configured such that contact between the first contact member and the second contact member completes a circuit and initiates illumination of the light for a set period of time.

6. The toothbrush of claim 5, wherein an inner surface of the handle defines a first cavity and an inner surface of the pliant base defines a second cavity and wherein the power source is positioned within the first cavity and the second contact member is positioned, at least partially, in the second cavity.

7. The toothbrush of claim 5, wherein the toothbrush has a longitudinal axis and with respect to the longitudinal axis, a base member is positioned between the power source and the first and second contact members.

8. The toothbrush of claim 7, wherein with respect to the longitudinal axis, the power source is positioned between the base member and the control circuit.

9. The toothbrush of claim 5, wherein the second contact has a flexible portion and an extension portion wherein the extension portion extends within the flexible portion.

10. The toothbrush of claim 5, wherein the second contact member comprises a helical spring, the first member and the helical spring both extend from a base member.

11. The toothbrush of claim 10, wherein the first member comprises a generally elongated rod extending from the base member and positioned within the helical spring.

12. The toothbrush of claim 11, wherein the helical spring has a first end coupled to the base and a second, opposite end that extends downwards towards the first contact member.

13. The toothbrush of claim 5, wherein the set period of time is about 60 seconds.

14. The toothbrush of claim 5, wherein the pliant base is and is connected to the handle in a sealed manner to prevent liquid from entering the toothbrush through the pliant base.

15. The toothbrush of claim 5, wherein the second contact member comprises at least one of a metal mesh, a truncated cone, and a helical spring.

16. The toothbrush of claim 5, wherein the pliant base is coupled to the second end of the handle at a first portion, the pliant base having a second portion configured to move in multiple directions with respect to the first portion to illuminate the light, including side to side and up and down.

17. The toothbrush of claim 16, wherein the second contact member is configured to move with the second portion of pliant base.

* * * * *